US007900789B2

(12) United States Patent
Johnston et al.

(10) Patent No.: US 7,900,789 B2
(45) Date of Patent: Mar. 8, 2011

(54) NON-REMOVABLE FINISH AND CLOSURE SYSTEM

(75) Inventors: Richard R. Johnston, Toledo, OH (US); Joseph P. Labadie, Perrysburg, OH (US); Lance J. Novotny, Gibsonburg, OH (US); Chris Danks, Waukesha, WI (US); John Wisniewski, Wanwatosa, WI (US)

(73) Assignee: Graham Packaging Company, LP, York, PA (US)

( * ) Notice: Subject to any disclaimer, the term of this patent is extended or adjusted under 35 U.S.C. 154(b) by 951 days.

(21) Appl. No.: 11/755,097

(22) Filed: May 30, 2007

(65) Prior Publication Data

US 2008/0296251 A1 Dec. 4, 2008

(51) Int. Cl.
*B65D 41/04* (2006.01)

(52) U.S. Cl. ..... 215/330; 215/331; 215/44; 220/288; 222/556

(58) Field of Classification Search ..... 215/44, 215/330, 331; 220/288; 222/556
See application file for complete search history.

(56) References Cited

U.S. PATENT DOCUMENTS

| | | | | |
|---|---|---|---|---|
| 1,849,522 | A * | 3/1932 | Hammer | 215/262 |
| 2,423,582 | A | 2/1945 | Coleman | |
| 4,053,077 | A * | 10/1977 | DeFelice | 215/217 |
| 4,084,716 | A * | 4/1978 | Bogert | 215/217 |
| 4,378,073 | A | 3/1983 | Luker | |
| 4,387,817 | A | 6/1983 | Wiles et al. | |
| 4,763,801 | A | 8/1988 | Nycz | |
| 4,821,898 | A | 4/1989 | Smalley | |
| 4,913,299 | A | 4/1990 | Petro | |
| 5,169,033 | A | 12/1992 | Shay | |
| 5,360,127 | A | 11/1994 | Barriac et al. | |
| 5,458,252 | A * | 10/1995 | Logel | 215/271 |
| 5,722,545 | A * | 3/1998 | Rinne | 215/44 |
| 5,803,291 | A | 9/1998 | Valles | |
| 5,810,184 | A * | 9/1998 | Adams et al. | 215/45 |
| 5,850,681 | A | 12/1998 | La Barre | |
| 6,047,840 | A | 4/2000 | Moore et al. | |
| 6,334,555 | B1 | 1/2002 | Randall et al. | |
| 6,669,063 | B1 | 12/2003 | Schneider et al. | |
| 6,769,895 | B2 | 8/2004 | Derouault et al. | |
| 2002/0162817 | A1 | 11/2002 | Vassallo | |
| 2006/0186077 | A1 * | 8/2006 | Robinson | 215/237 |
| 2006/0186078 | A1 | 8/2006 | Ziegenhorn | |
| 2007/0034595 | A1 | 2/2007 | Foster et al. | |
| 2008/0000932 | A1 * | 1/2008 | Cleary et al. | 222/215 |

FOREIGN PATENT DOCUMENTS

| | | | |
|---|---|---|---|
| EP | 0 812 777 | A | 12/1997 |
| GB | 884 691 | A | 12/1961 |
| GB | 2 108 095 | A | 5/1983 |

OTHER PUBLICATIONS

International Search Report for PCT/US2008/065027 and Written Opinion.

* cited by examiner

*Primary Examiner* — Anthony Stashick
*Assistant Examiner* — James N Smalley
(74) *Attorney, Agent, or Firm* — Rissman Hendricks & Oliverio, LLP

(57) ABSTRACT

Non-removable finish and closure finish system that resists rotational movement so as to be rendered substantially non-removable by the consumer. The closure and finish have complementary thread segments with ratchet-type engaging portions or lugs extending below thread segments on the finish and closure, the closure lugs being disposed on an inner skirt spaced radially inwardly from an outer skirt to inhibit access to the interlocking lugs.

9 Claims, 5 Drawing Sheets

NON-REMOVABLE FINISH AND CLOSURE SYSTEM

FIELD OF THE INVENTION

The invention relates to threaded closure and finish systems and more particularly to a closure and finish system in which the closure, once applied, substantially resists rotational movement and is rendered substantially non-removable by the customer.

BACKGROUND OF THE INVENTION

There are a variety of food, beverage and healthcare products for which a non-removable closure would be advantageous. A non-removable closure system is generally understood to be one in which, following attachment of the closure to the container body, the closure cannot be detached from the container without deliberately applying such large forces that would at least partially damage the container and/or the closure. Such damage would thus prevent continued use of the container body and/or closure.

For example, it is well known to provide an injection molded preform with a relatively thick finish area having an external thread, and a lower body portion that is subsequently blow molded to form a relatively thin container body. The relatively thick finish wall provides the necessary structural strength for secure application of a closure having a complementary internal threaded portion, while the expanded container body is sufficiently strong to withstand product filling, handling and expected use, but is often substantially weaker than the finish area. The preform(s)/container(s) for such applications are typically made from thermoplastic polymers such as polyesters (e.g., polyethylene terephthalate PET) and polyolefins (e.g., polypropylene or polyethylene). The closure is also typically a molded plastic article, formed separately from the container, and may be made of polyolefin or polyester.

Most applications for such thermoplastic containers and closures are single use applications, wherein the container and closure are essentially discarded after the product is used. In such applications, it is desirable to minimize the amount of material required, and minimize the complexity of the injection and blow molding equipment, in order to produce the container and closure at a competitive price. These limitations on material usage and equipment/process complexity are also constraints on the design of a non-removable closure/container system where it is desired that customer be unable to remove the closure and refill (reuse) the container. However, these constraints make it more difficult to design a closure/container system with sufficient structural integrity to withstand (resist) customer attempts to remove the closure.

SUMMARY OF THE INVENTION

In one embodiment, a non-removable closure and finish system is provided comprising:

a plastic container having a longitudinal axis and an upper cylindrical neck finish with at least two thread segments symmetrically disposed around an outer wall of the finish;

a plurality of finish lugs disposed beneath the finish thread segment adjacent a lowermost end of each finish thread segment;

a plastic closure having a top wall, an outer skirt and an inner skirt disposed radially inwardly from the outer skirt, at least two closure thread segments symmetrically disposed around an inner wall of the inner skirt and adapted to lie beneath a respective finish thread segment, and;

a plurality of closure lugs adjacent a lowermost end of each closure thread segment, the closure lugs being disposed to lie between the finish lugs for resisting removal of the closure from the finish.

In one embodiment, each closure lug has a ramp edge to facilitate application of the closure to the finish, and an opposed abutment edge for locking the closure to the finish. Similarly, the finish lug may have a ramp edge to facilitate application of the closure to the finish and an opposed abutment edge for locking the closure to the finish. A projecting stop may be provided at a lowermost end of the finish thread segment to prevent over-torquing of the closure onto the finish.

In one embodiment, the inner skirt is of a lesser height than the outer skirt, wherein the height is defined with respect to the central container axis. Providing the closure lugs on the inner skirt, and more preferably on an inner skirt of lesser height, makes it more difficult to access the lugs if attempts are made to disengage by the lugs. Also, some or all of the lugs may be greater in height than the thread segments in order to increase the resistance of the lug locking mechanism to disengagement.

In one embodiment, the finish is relatively more rigid than the closure. The finish thread segments and lugs may be relatively more rigid than the closure thread segments and lugs.

In one embodiment, the closure and/or the finish are each an injection molded article. The finish and closure may be molded from plastic materials such as polyolefins, e.g. polypropylene or polyethylene, or polyesters, e.g. PET. Alternatively, the finish and/or closure may be extrusion or compression molded. The finish may also be blow molded or otherwise expanded after initial molding.

In one embodiment, there are at least two diametrically opposed thread segments on each of the closure and finish. The finish thread segments may have overlapping ends, as well as the closure thread segments; this provides greater rigidity and resistance to removal of the closure. Depending on the finish size, there may be four, six or more sets of diametrically opposed thread segments on each of the closure and finish.

In one embodiment, the finish and closure each have three or more lugs e.g., four, six or more, depending on the finish size. The lugs may be integral with the lower thread surface, or spaced therefrom. The lugs may be spaced apart from one another, or integral. The finish and closure lugs preferably prevent any rotational movement to loosen the closure on the finish. The abutting surfaces of the finish and closure lugs may apply a positive sealing force between an inner surface of the closure and a top sealing surface of the finish.

In one embodiment, the container finish and closure form a standing end, e.g. of a top down or inverted container. As a further option the container may have at least one gripping surface or labeling surface and the finish lugs may be positioned to orient a hinge or spout on the closure with respect to the at least one gripping surface or labeling surface.

In another embodiment, a non-removable closure and finish system is provided comprising:

complementary sets of thread segments on the closure and finish, each segment having a plurality of ratchet-type engaging portions disposed adjacent one end of the segment, each engaging portion having a ramped leading edge to facilitate rotation in one direction and a trailing abutment edge to resist rotation in the opposite direction; and the closure having an outer skirt and an inner skirt, the inner skirt being radially spaced from the outer skirt and having an inner wall on which the thread segments and engaging portions are disposed.

In one embodiment, the engaging portions on the finish are disposed below the finish thread segment, and the engaging portions on the closure are spaced from the one end of the closure thread segment. The engaging portions on the finish may extend from a lower surface of the finish thread segment. Alternatively, the engaging portions on the finish may be spaced from a lower surface of the thread segment. The engaging portions on the closure may extend below the closure thread segments or be spaced apart from the closure thread segments. A stop may be provided at one end of the finish thread segment to prevent over-torquing. Another stop may be provided on the inner wall of the inner skirt to engage the leading edge of the finish thread segment, for the same purpose. The closure (once applied) may thus be rendered substantially non-rotational in both directions. In a still further embodiment, the finish engaging portions may have a diameter greater than the finish thread segment diameter, and the closure engaging portions may have a diameter less than the closure thread segment diameter

BRIEF DESCRIPTION OF THE DRAWINGS

The above and further advantages of various embodiments of the invention may be better understood by referring to the following description in conjunction with the accompanying drawings in which.

DETAILED DESCRIPTION

One or more embodiments of the present invention will now be described with respect to the container and closure illustrated in FIGS. 1-4. This embodiment is given by way of example only, and is not meant to be limiting.

Figure 1:
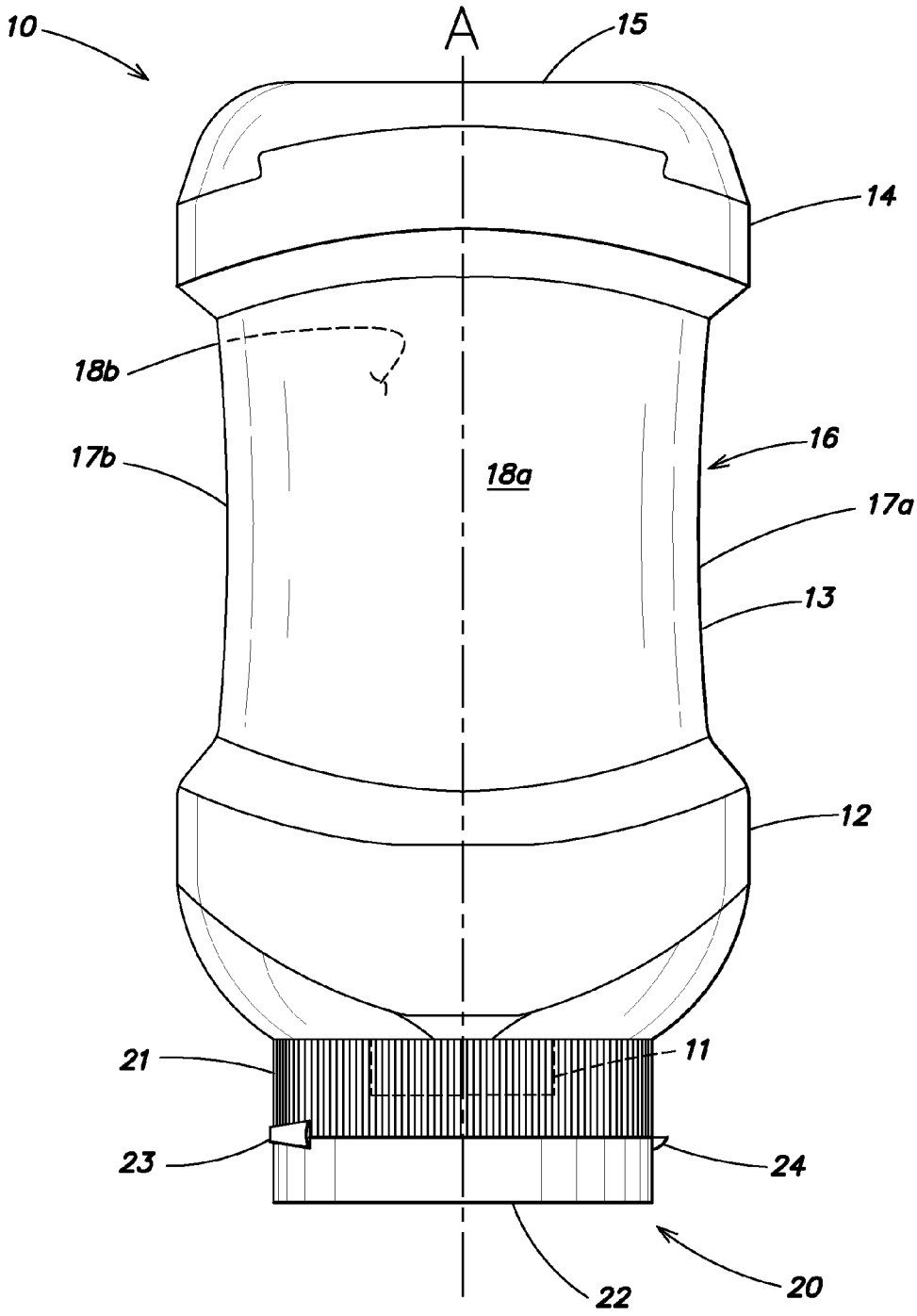
FIG. 1 is a perspective view of a food container and non-removable closure according to one embodiment of the invention.

FIG. 1 shows a container 10 having a closure 20. The container is shown "upside down" because it is designed to function as an inverted dispensing container (a.k.a. top down package) for ketchup or other viscous food products (e.g., mayonnaise, mustard), there being advantages in providing a dispensing container in which the closure forms a standing surface of the container. As is well known in the art, this facilitates dispensing of the product by the consumer.

This particular container is intended for use in commercial establishments, e.g. restaurants, and is provided with a substantially non-removable closure. This enables the product manufacturer to deliver a filled container to the retail establishment (restaurant) and prevents (restaurant employee(s) from refilling the container. In this embodiment, the force required to remove the closure is sufficiently high that the closure cannot be manually removed (by hand). Furthermore, if a mechanical element (tool) is used by an employee in an attempt to remove the closure, e.g., a long thin instrument such as a knife, the difficulty in accessing the locking mechanism between the closure and finish and the respective strengths of the container and closure are such that the bottle and/or closure will be substantially deformed so as to be rendered unusable (if the employee is successful in removing the closure). Most likely the container will be crushed or buckle and thus rendered unacceptable for further use in a commercial establishment.

The container 10 has a finish portion 11 (shown generally in phantom lines in FIG. 1 as it is covered by the closure 20) and an integral body portion 16. The body portion includes a sidewall having an upper shoulder 12, a central label panel area 13, and a lower shoulder 14, and below the sidewall is a closed end 15 (normally referred to as the base). The closure 20 includes a flip top cover 22 joined by a hinge 23 to a lower closure portion which includes a top wall 67 having a dispensing aperture 29 (see FIG. 3) and an outer circumferential skirt 21. A lip 24 on the flip top 22 facilitates opening of the cover. In this embodiment, the container panel area 13 is substantially rectilinear, comprising two pairs of diametrically opposed gripping surfaces (17*a*, 17*b* and 18*a*, 18*b* respectively). As described below, the closure is preferably oriented with respect to the gripping surfaces for ease of handling. The container is otherwise generally substantially symmetrical with respect to a longitudinal container axis A.

Figure 2A:
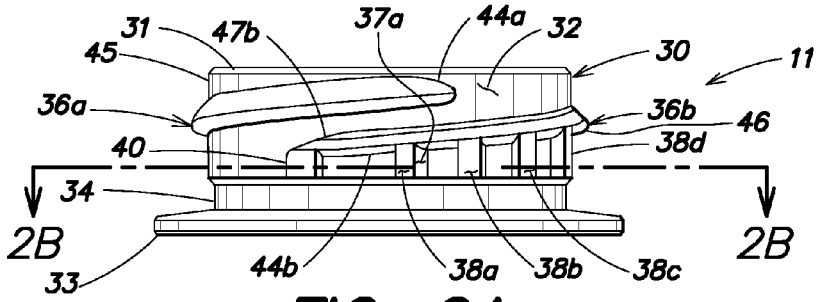
FIG. 2A is a side plan view of the finish of the container of FIG. 1.
Figure 2B:
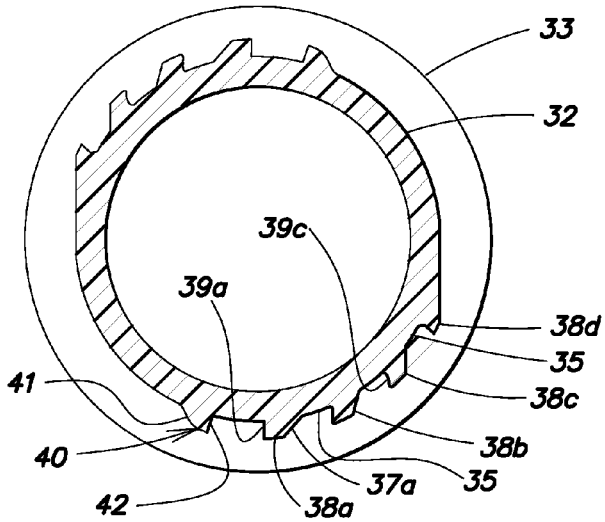
FIG. 2B is a sectional view taken along lines 2B-2B of FIG. 2A.
Figure 2C:
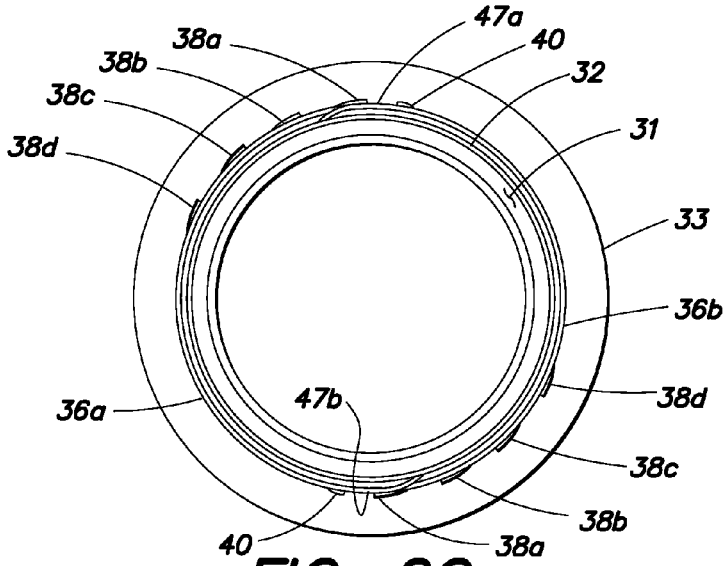
FIG. 2C is a top plan view of the finish of FIG. 2A.

FIGS. 2A, 2B and 2C show side, sectional and top views of the container finish 11. The finish has an open mouth defined by a cylindrical top sealing surface 31, and an upper cylindrical thread finish portion 30 having an outer wall 32 with two thread segments 36*a* and 36*b*. The two thread segments are symmetrically disposed about the circumference of the cylindrical outer wall 32, and are diametrically opposed. The thread segments have circumferentially overlapping end portions 44*a* and 44*b*, which further enhance secure attachment of the closure to the finish. Below the upper thread portion 30 is a cylindrical recess 34 (without threads and of lesser diameter) and below the recess a lower support flange 33. The flange 33 is generally used for handling and/or supporting the container, or the preform from which the container is blow molded.

In accordance with the present embodiment, the finish 11 has a plurality of lugs which engage complementary lugs on the closure and provide a locking mechanism that renders the closure 20 substantially non-removable. In this embodiment, there are four (4) spaced-apart vertical lugs 38*a*, 38*b*, 38*c* and 38*d*, provided adjacent the lowermost end 47*a* and 47*b* of each thread segment 36*a* and 36*b*, and formed integral with and extending down from each of the respective thread segments 36*a* and 36*b*. The lugs effectively function as ratchet teeth which allow rotational movement in only one direction. The spaced-apart lugs or ratchet teeth 38 are separated by outer wall portions 35 between each pair of adjacent lugs. These spaces or wall portions 35 form notches which receive complementary shaped lugs or ratchet teeth on the closure, as shown in FIGS. 3 and 4.

The closure 20 has inner thread segments 60*a* and 60*b* which are designed to sit below and support the finish thread segments 36*a* and 36*b*, respectively. Each of the finish lugs 38*a*-*d* (see FIG. 2B) has a ramped edge 37*a*-*d* on one side and an opposing abutment edge 39*a-d* on the opposite side. Similarly, each of the closure lugs 64*a-d* (see FIG. 3) has a ramped edge 65*a-d* on one side and on opposing abutment edge 66*a-d* on the opposite side. The ramped edges 37, 65 facilitate application (ease of rotation in the clockwise direction) of the closure onto the finish (positive rotation), while the abutment edges 39, 66 resist removal (prevent manual rotation in the counterclockwise direction) of the closure from the finish (negative rotation).

Also provided at the end of each thread segment 36*a* and 36*b* is a projecting portion 40 which functions as a stop. Stop 40 prevents over-torquing of the closure threads onto the finish threads, i.e., it prevents the closure threads and/or lugs from jumping over the finish threads during application of the closure to the finish.

Figure 3:
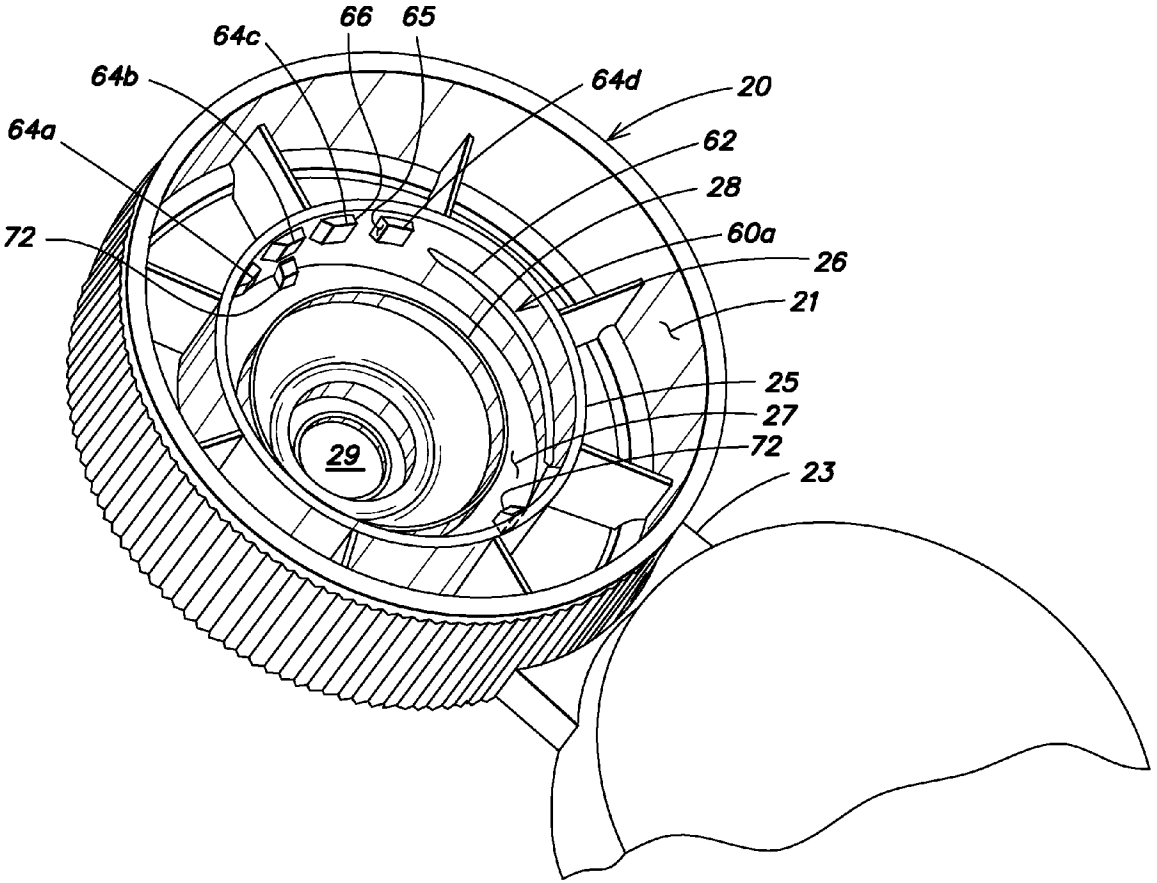
FIG. 3 is a bottom perspective view of the closure of FIG. 1A, including a partial view of the hinged cover (flip top) in the open position.

FIGS. 3-4 show various features of the closure 20. The closure has a lower portion formed by an outer cylindrical skirt 21 which depends downwardly from a top wall 67. The top wall has a central aperture 29 for dispensing of the product; the aperture may include a nozzle fitment or valve system to prevent leakage or dispensing of the product unless the container is squeezed.

As shown in FIG. 3, which is a bottom (interior) view of the lower closure portion, a cylindrical outer skirt 21 depends from the periphery of the top wall 67. An inner skirt 25 is disposed radially inwardly with respect to the outer skirt 21 and connecting ribs (spokes) 26 are symmetrically disposed between the inner and outer skirts. The spokes provide structural support to both the inner and outer skirts and increase the closure's resistance to deformation by tampering or other efforts to remove the closure from the finish. The outer skirt 21 is longer (in the longitudinal direction A) than the inner skirt 25. Again this is useful for enhancing tamper resistance and preventing access to the locking mechanism (lugs) on the closure and finish. Further, a pair of diametrically opposed blocking lugs 72 are provided on the inner wall of the inner skirt to engage the ramped leading edge of each finish thread segment, which also prevents over-torquing.

A third skirt or sealing ring 28 lies radially within the inner skirt and is of a lesser height than the inner skirt 25. The ring 28 has an outer wall that forms a sealing surface for engaging an upper edge portion 45 of the finish wall 32. The top sealing surface 31 of the finish engages a sealing surface 27 on the bottom of top wall 67, between sealing ring 28 and inner skirt 25. The sealing engagement of 28/45 and 27/31 provide both structural support between the closure and finish and prevention of product leakage.

Figure 4A:
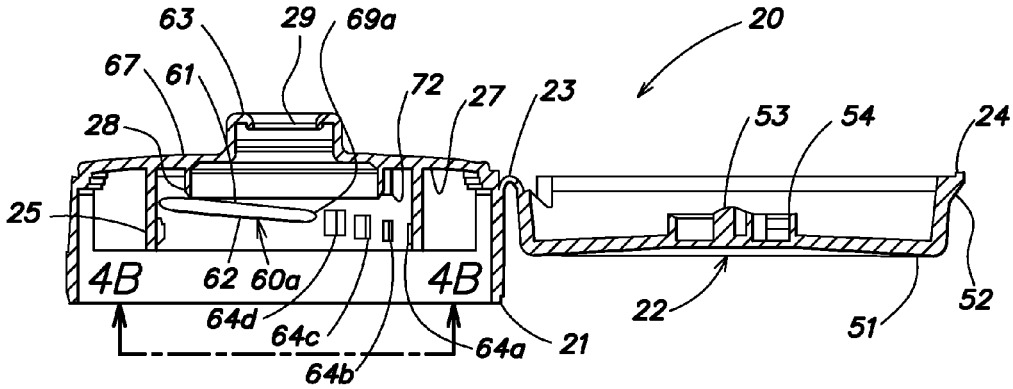
FIG. 4A is a cross sectional view of the closure of FIG. 3.
Figure 4B:
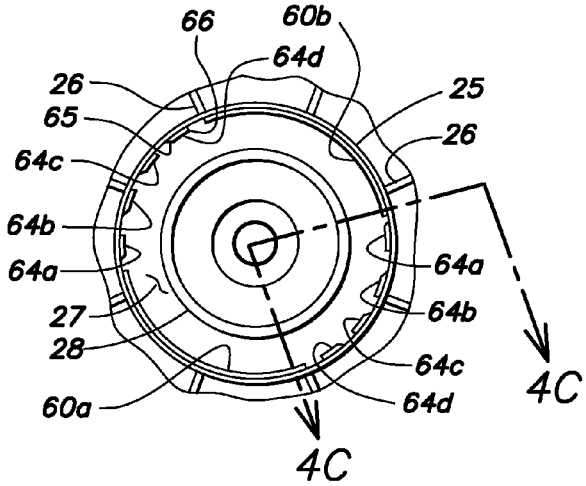
FIG. 4B is a partial sectional view taken along lines 4B-4B in FIG. 4A, showing the inner skirt and central dispensing aperture.
Figure 4C:
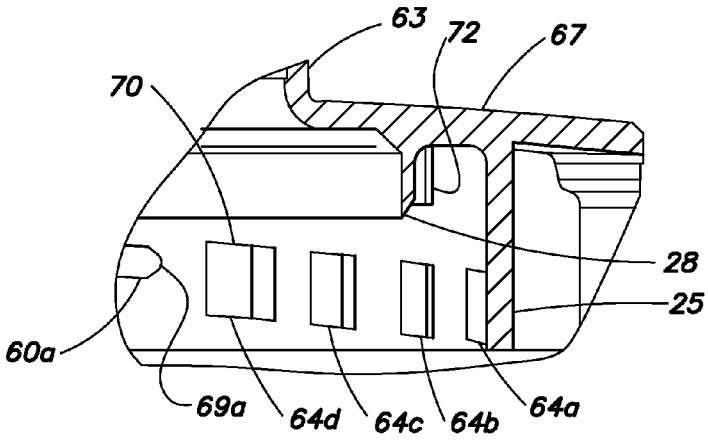
FIG. 4C is a partial enlarged sectional view taken along lines 4C-4C in FIG. 4A, showing a stop and four ratchet teeth at one end of a closure thread segment on the inner surface of the inner skirt.
Figure 4D:
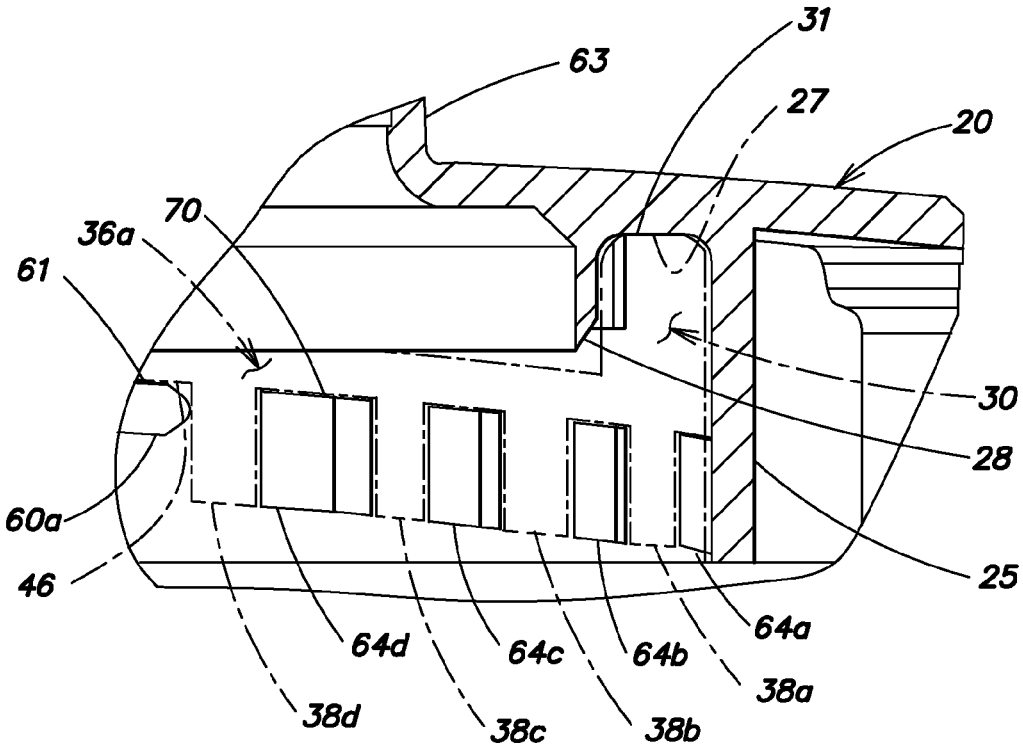
FIG. 4 D is a partial enlarged sectional view similar to FIG. 4C, but showing in phantom lines portions of the neck finish (of FIG. 2A) after the closure is threaded onto the finish.

As best shown in FIGS. 4A and 4C, each of the closure thread segments 60*a* and 60*b* has an upper surface 61 and a lower surface 62. The upper surface 61 is designed to sit below and engage (support) the lower surface 46 of the finish thread segment 36*a* or 36*b*. Each of closure thread segments 60*a* and 60*b* has adjacent its lowermost end 69*a*, 69*b* a plurality of closure lugs 64*a-d* (ratchet teeth), formed integral with and extending down from thread segments 60*a* and 60*b*. Each lug has a ramped edge 65 on one side, and an abutment edge 66 on the other side, the ramped edge 65 facilitating application of the closure thread to the finish thread, and the abutment edge 66 engaging the abutment edge 39 of the corresponding finish lug 38 to prevent removal of the closure from the finish. In this embodiment, the closure lugs 64*a-d* are vertically disposed and spaced apart, forming notches which receive finish lugs 38*a-d*. The upper edge 70 of each closure lug 64 is aligned with (forms a continuation of) a helical line formed by the upper surface 61 of the closure thread segment 60. The closure lugs 64 are of a height (in the longitudinal direction A) greater than the height of the thread segments 60, and thus extend below a helical line formed by the lower surface 62 of the thread segments. The greater height (of the closure lugs compared to the closure thread) provides increased resistance to removal of the closure from the finish.

There has thus been described an embodiment of the present invention comprising a locking mechanism for preventing reverse (loosening) rotation of the closure by application of manual force. The abutting surfaces of the ratchet teeth (lugs) on each of the closure and finish prevent such reverse rotation. The amount of force required to overcome the lugs is sufficiently high that the closure cannot be manually removed. If a user attempts to deform the container or closure either manually or with a tool in order to gain access to the locking mechanisms (ratchet teeth), such efforts are substantially thwarted by providing the ratchet teeth on the inner skirt of the closure. Because this inner skirt is radially inwardly disposed with respect to the outer skirt, and also of a lesser height, simple insertion of a knife beneath the lower edge of the outer skirt will not be sufficient to engage or disrupt the locking mechanism. Generally, the structural integrity of each of the closure and container will be such that any successful effort to reach the locking mechanism and overcome the lugs will substantially deform either the closure or container (or both) such that they will be rendered unusable.

In alternative embodiments, the number, placement and dimensions of the lugs or ratchet teeth can be varied on one or more of the closure and finish. There should be at least two lugs on each of the closure and finish, with four or more being preferred (e.g., 4, 5, 6 . . . ) in select applications. Also, the number of thread segments can be varied. There should be at least two thread segments which are preferably diametrically opposed, so that the forces between the closure and finish are evenly distributed around the circumference of the closure and finish. Preferably, the thread segments have overlapping ends for greater engagement of the closure and finish thread segments. More than two thread segments can be provided; however it may be more difficult to remove an injection molded finish with more than two thread segments from the injection mold. Alternatively, there may be four thread segments. If more thread segments are used, there may be a lesser number of lugs associated with each thread segment.

Another benefit of the present embodiment is a reduced finish height, which for an inverted container is generally more stable. The two thread segments can be provided with a relatively steep pitch so there is sufficient vertical height to add the lugs below the thread segments on the outer wall 32. In the present embodiment, the thread pitch is about 0.167 inch and the thread lead 0.334 inch. The height of the finish is 0.530 inch. In contrast, a typical prior art finish for this type of container is 0.650 inch. By providing a lower finish height, there is less material used and a resulting cost savings. Also, by injection molding the lugs of both the finish and closure, a more rigid locking mechanism is provided.

In the described embodiment, it was found to require about 30 inch-pounds of force to apply the closure to the finish. Providing a stop at the end of the thread segments prevents the ratchets and threads from jumping over the threads if a very high application force, e.g., 60-70 inch-pounds, is applied.

In the present embodiment the height of at least some of the lugs (in the axial direction A) is four times greater than the height of the thread segments. Preferably, at least some of the lugs are at least double the height of the thread segment.

In the present embodiment the closure lugs are spaced from and separate from the end of the thread segment. Alternatively, the closure lugs may be integral with and/or below the closure thread segments.

The material used for the closure and finish will depend upon the particular application. In the present embodiment, the closure is made of polypropylene, and the container is made from bottle grade polyethylene terephthalate (PET) resin. The container is made from an injection molded preform, the body portion of which is blow molded to form the container body. The finish has an outer diameter of 33 mm, a wall thickness (upper portion 32) of 0.088 inch, a thread diameter (T dimension) of 1.255 inch, and a lug diameter of 1.270 inch; the sidewall thickness of the container is about 0.63 mm. The closure in the present embodiment is injection molded. The closure has an inside wall diameter of about 33 mm, a wall thickness of 0.045 inch, a thread diameter on the inside wall (E dimension) of 1.224 inch, a thread diameter (T dimension) of 1.280 inch, and a lug diameter of 1.272 inch. By making the finish lug diameter greater than the finish thread diameter, the closure lug diameter can be made less than the closure thread diameter; this makes it easier to strip the closure from the injection mold. Also, by extending the lugs closer to the closure wall and minimizing the distance/gap/clearance, the ability to deflect the lugs/notches is reduced and the non-removability of the closure thus enhanced. For greater rigidity, both the finish and closure can be injection molded from PET. Preferred ranges for the finish and closure are:

for the finish:
outer diameter 28-89 mm
wall thickness 0.045-0.110 inch
thread diameter (T dimension) 1.078-3.494 inch
lug diameter±0.015 of the thread dimension
for the closure:
inside wall diameter 28-89 mm
wall thickness 0.030-0.110 inch
thread diameter on inside wall (E dimension) 1.047-3.463 inch
wall diameter 1.103-3.519
lug diameter 1.239-3.655

The container body (sidewall or weakest area) would typically have a wall thickness of 0.015-0.080 inch.

In alternative embodiments, the container and/or finish may be extrusion molded or compression molded. The finish may also be blow molded or otherwise expanded after the initial molding step.

There are various advantages to providing a substantially non-removable and substantially non-rotatable closure and finish assembly. One benefit is to provide security to the customer that the product has not been tampered with. A second benefit is an improvement of the mechanical seal between the top sealing surface and the closure, which prevents leakage. A third benefit of the locking mechanism is that it provides an orientation point about the circumference of the container, which can be used to insure that the gripping orientation of the closure with respect to the container is fixed, i.e., the hinge on the flip top is positioned with respect to the nonsymmetrical container body to facilitate gripping of the container by the user and dispensing of the product. One or more of these advantages may be useful in a particular application.

These and other modifications would be readily apparent to the skilled person as included within the scope of the described invention.

The invention claimed is:

1. A non-removable plastic closure and finish system comprising:

complementary sets of thread segments on the closure and finish, each segment having a plurality of ratchet-type engaging portions disposed adjacent one end of the segment, each engaging portion having a ramped leading edge to facilitate rotation in one direction and a trailing abutment edge to resist rotation in the opposite direction; and the closure having an outer skirt and an inner skirt, the inner skirt being radially spaced from the outer skirt and having an inner wall on which the thread segments and engaging portions are disposed, wherein the engaging portions on the finish are disposed below the finish thread segments, and the engaging portions on the closure are spaced apart adjacent the one end of the closure thread segment.

2. The system of claim 1, wherein at least some of the engaging portions are at least double a height of the thread segments.

3. The system of claim 2, wherein the finish engaging portions are integral with the finish thread segment.

4. The system of claim 2, wherein the finish engaging portions are spaced from the finish thread segment.

5. The system of claim 1, wherein a stop is provided at the one end of the finish thread segment.

6. The system of claim 1, wherein a stop is provided on the inner wall of the inner skirt to engage the leading edge of the finish thread segment.

7. The system of claim 1, wherein there are two sets of thread segments on the closure and finish with overlapping ends.

8. The system of claim 1, wherein the finish engaging portions have a diameter greater than the finish thread segment diameter, and the closure engaging portions have a diameter less than the closure threat segment diameter.

9. The system of claim 1, wherein each closure thread segment has an upper surface that engages and supports a lower surface of the finish thread segment.

* * * * *

UNITED STATES PATENT AND TRADEMARK OFFICE

CERTIFICATE OF CORRECTION

PATENT NO. : 7,900,789 B2
APPLICATION NO. : 11/755097
DATED : March 8, 2011
INVENTOR(S) : Johnston et al.

It is certified that error appears in the above-identified patent and that said Letters Patent is hereby corrected as shown below:

In column 8, line 46,

"threat" should be --thread--

Signed and Sealed this
Thirty-first Day of May, 2011

David J. Kappos

David J. Kappos
*Director of the United States Patent and Trademark Office*